US011741832B2

(12) United States Patent
Ratrout et al.

(10) Patent No.: US 11,741,832 B2
(45) **Date of Patent: *Aug. 29, 2023**

(54) METHOD FOR TRAFFIC FLOW ANALYSIS AND TIMING BASED ON VEHICULAR VOLUME FLOW

(71) Applicant: King Fahd University of Petroleum and Minerals, Dhahran (SA)

(72) Inventors: Nedal Ratrout, Dhahran (SA); Khaled Assi, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 108 days.

This patent is subject to a terminal disclaimer.

(21) Appl. No.: 17/402,812

(22) Filed: Aug. 16, 2021

(65) Prior Publication Data

US 2021/0398423 A1 Dec. 23, 2021

Related U.S. Application Data

(63) Continuation of application No. 16/448,825, filed on Jun. 21, 2019, now Pat. No. 11,120,686.

(51) Int. Cl.
*G08G 1/09* (2006.01)
*G08G 1/08* (2006.01)
(Continued)

(52) U.S. Cl.
CPC ..... *G08G 1/09* (2013.01)

(58) Field of Classification Search
CPC ..... G08G 1/0116
See application file for complete search history.

(56) References Cited

U.S. PATENT DOCUMENTS 7,991,542 B2 * 8/2011 Giles ..... G08G 1/0104 701/119
10,043,385 B2 * 8/2018 Thalanany ..... G08G 1/081
(Continued)

FOREIGN PATENT DOCUMENTS

CN 107886742 A 4/2018
WO 2018/072240 4/2018

OTHER PUBLICATIONS

Assi, at al. ; Proposed quick method for applying dynamic lane assignment at signalized intersections ; IATSS Research 42 ; pp. 1-7; Mar. 19, 2017; 7 Pages.
(Continued)

*Primary Examiner* — Joseph H Feild
*Assistant Examiner* — Pameshanand Mahase
(74) *Attorney, Agent, or Firm* — Oblon, McClelland, Maier & Neustadt, L.L.P.

(57) ABSTRACT

A method for determining space allocation and signal timing of an isolated signalized intersection consists of at least one remote server and a processing module that is communicably coupled with the at least one remote server. A plurality of traffic-related data, wherein the plurality of traffic-related data reflects activity at the isolated signalized intersection, is received through the processing module. A space determination process is performed on the plurality of traffic-related data through the processing module. Next, a timing determination process is performed on the plurality of traffic-related data through the processing module in order to minimize the average intersection delay at the isolated signalized intersection. Based upon the results from the space determination process and the timing determination process a cycle length is determined for the isolated signalized intersection.

13 Claims, 16 Drawing Sheets

(51) Int. Cl.
*G08G 1/095* (2006.01)
*G08G 1/07* (2006.01)

(56) References Cited

U.S. PATENT DOCUMENTS

| | | | | |
|---|---|---|---|---|
| 11,120,686 | B2 * | 9/2021 | Ratrout | G08G 1/08 |
| 2003/0195696 | A1 | 10/2003 | Jones | |
| 2013/0027224 | A1 * | 1/2013 | Wang | G08G 1/07 340/932 |
| 2016/0027299 | A1 * | 1/2016 | Raamot | G08G 1/0112 340/917 |
| 2019/0236948 | A1 | 8/2019 | Wang et al. | |

OTHER PUBLICATIONS

Zhou, et al. ; Optimization of Variable Approach Lane Use at Isolated Signalized Intersections ; Transportation Research Record: Journal of the Transportation Research Board, No. 2556, Transportation Research Board, Washington, D.C., 2016, pp. 65-74 ; 10 Pages.

Lam, et al. ; Integrated Model for Lane-Use and Signal-Phase Designs ; Journal of Transportation Engineering 123 (2) ; Mar. 1997; Abstract Only; 4 Pages.

* cited by examiner

METHOD FOR TRAFFIC FLOW ANALYSIS AND TIMING BASED ON VEHICULAR VOLUME FLOW

CROSS-REFERENCE TO RELATED APPLICATIONS

The present application is a Continuation of U.S. application Ser. No. 16/448,825, now allowed, having a filing date of Jun. 21, 2019.

BACKGROUND

Field of the Invention

The present disclosure relates to a procedure for signal time planning upon identifying a phasing scheme and selecting a lane allocation. In one aspect the procedure is applicable for any quantity of vehicles that is at an intersection. In particular, the method of the present disclosure provides a signal-timing plan that takes into account intersection space at an intersection and provides a phasing scheme for the intersection.

Description of the Related Art

A major cause of traffic congestion at intersections is the fluctuation of the volume of traffic. Signal phasing schemes are usually selected based on traffic demand characteristics. In general, an approach-based phasing scheme is used at signalized intersections where each phase is fully protected and allocated for left, right, and through movements of a given approach. The approach-based phasing scheme, illustrated in FIG. 2, is preferable due to the ease of implementation. However, a concern of the approach-based phasing scheme is the inability to adjust according to the volume changes of an approach. Lane usage violations where vehicles make turns from exclusive through lanes and vice versa also contribute to traffic congestion. See Habibi, H. (2016), Assessment of dynamic lane grouping for isolated signalized intersection and application of machine learning models (Master dissertation, King Fand University Of Petroleum & Minerals), incorporated herein by reference in its entirety.

In FIG. 3, a movement-based phasing scheme is illustrated where traffic is controlled based on the movement of opposite approaches and lane usage violations are generally eliminated. However, similar to the approach-based phasing scheme, volume changes of opposing approaches can still lead to traffic congestion with the movement-based phasing scheme.

A majority of traffic signal control strategies assume fixed lane utilization at intersection approaches. Fixed lane utilization, also known as fixed lane assignment (FLA), can lead to degrading the performance of an intersection under fluctuating demand characteristics. Dynamic lane assignment (DLA) is an intelligent transportation system (ITS) application which performs lane allocation based upon the real-time turning movement demand. DLA is proven to reduce the average intersection delay when applied at a selected signalized intersection.

The first cycle length was developed using an objective of minimizing the total delay for all vehicles. See Webster, F. V. (1958). Traffic signal settings, incorporated herein by reference in its entirety. The formula derived for the cycle length depends on the total lost time and a summation of critical volume to saturation flow ratios (critical flow ratio) and is given by equation 1:

$$C_{opt} = \frac{1.5L + 5}{1 - Y} \qquad \text{Equation–1}$$

$C_{opt}$—cycle length;

L—Total lost time;

Y—Summation of critical flow ratios; Considering Webster's formula listed in equation 1, $C_{opt}$ will be either too large or inapplicable for a high value of Y. The cycle length is defined as the total signal time to serve all of the signal phases including the green time plus any change interval. Longer cycles will accommodate more vehicles per hour but that will also produce higher average delays. Thus, Webster's formula cannot be applied to a situation where a large volume of vehicles needs to be taken into consideration.

Attempts have been made to modify equation 1 to reflect different volumes of vehicles at a four-legged intersection. See Cheng, D., Messer, C. J., Tian, Z. Z., & Liu, J. (2003, January). Modification of Webster's minimum delay cycle length equation based on HCM 2000. *In the* 81*st Annual Meeting of the Transportation Research Board* in Washington, D.C., incorporated herein by reference in its entirety. The total lost time was obtained through highway capacity manual delay equations. Equation 1 was recalibrated and modified to create an exponential cycle length model. The exponential cycle length model provided considerably accurate results for the cycle length when compared to equation 1. However, the exponential cycle length model was still inapplicable when a value of Y in equation 1 was equal to or greater than 1.

Another exponential regression model was developed by developing a search algorithm to find the cycle length that minimizes the intersection delay. See Zakariya, A. Y., & Rabia, S. I. (2016). Estimating the minimum delay optimal cycle length based on a time-dependent delay formula. *Alexandria Engineering Journal,* 55(3), 2509-2514, incorporated herein by reference in their entirety. To do so, the saturation flow rate was assumed to be fixed for all movements at 1820 vehicles/hour (v/h). Moreover, the lost times were assumed to be 5-seconds (s), 6 s, 7 s, and 8 s only. The unrealistic cycle lengths predicted when the value of Y equation 1 approaches 1, is the main drawback of the exponential regression model. Thus, the exponential regression model can only be used for lost times of 5 s, 6 s, 7 s, and 8 s.

After analyzing the impacts of dynamic lane assignment at one approach of a signalized intersection, Zhong proposed a time-space combination. The analysis results obtained under the time-space combination revealed a benefit scheme. See Zhong, Z., Liu, H., Ma, W., & Long, K. (2008, October). An optimization method of dynamic lane assignment at signalized intersection. In Intelligent Computation Technology and Automation (ICICTA), 2008 International Conference on (Vol. 1, pp. 1277-1280). IEEE, incorporated herein by reference in its entirety.

When the Paramics simulation software was used to analyze the effects of DLA on one approach of a hypothetical isolated signalized intersection, the DLA strategy was proven to improve the operational performance, wherein the operational performance was based upon the average vehicle delay and the number of stops. See Wu, G., Boriboonsomsin, K., Zhang, L., & Barth, M. J. (2012, September). Simulation-based benefit evaluation of dynamic lane grouping strategies at isolated intersections. In Intelligent Transportation Systems (ITSC), 2012 15*th International IEEE Conference on* (pp. 1038-1043). IEEE, incorporated herein by reference in its entirety.

When the effects of dynamic lane grouping were analyzed using mathematical programming under predefined demand levels that were assumed and a fixed cycle length of 120 s, only one-approach of the four-legged intersection had variable traffic demand and dynamic lane assignment. Since the objective of the study was to minimize the maximum flow rate, the lane grouping strategy was proven to improve the mobility performance in terms of reduction in average vehicle delay and number of stops. See Zhang, L., & Wu, G. (2012). Dynamic lane grouping at isolated intersections: problem formulation and performance analysis. *Transportation Research Record: Journal of the Transportation Research Board,* (2311), 152-166, incorporated herein by reference in its entirety.

An objective of a model for DLA developed through integer nonlinear programming is to minimize the sum of critical flow ratios. In a first case of the study, the integer nonlinear programming model was applied to one approach of the four-legged intersection. In a second case of the study, the integer nonlinear programming model was applied to two opposing approaches of the four-legged intersection. When compared to the fixed lane assignment (FLA) described earlier, the intersection delay was decreased by 14.7% with the integer nonlinear programming model. However, the integer nonlinear programming model was not applied to the approaches simultaneously. See Zhao, J., Ma, W., Zhang, H., & Yang, X. (2013). Increasing the capacity of signalized intersections with dynamic use of exit lanes for left-turn traffic. *Transportation Research Record: Journal of the Transportation Research Board,* (2355), 49-59, incorporated herein by reference in its entirety.

A MATLAB model was developed to analyze the effect on the performance of signalized intersections when both space and signal timing are considered. The objective of the MATLAB model was to minimize the average intersection delay. Even though the performance at the signalized intersection improved according to the MATLAB model, only an approach-based phasing scheme was considered in the study. Moreover, the MATLAB model also assumed that shared lanes existed on the far left and right lanes. See Alhajyaseen, W. K., Najjar, M., Ratrout, N. T., & Assi, K. (2017). The effectiveness of applying dynamic lane assignment at all approaches of signalized intersection. *Case studies on transport policy,* 5(2), 224-232; and Alhajyaseen, W. K., Ratrout, N. T., Assi, K. J., & Hassan, A. A. (2017). The Integration of Dynamic Lane Grouping Technique and Signal Timing Optimization for Improving the Mobility of Isolated Intersections. *Arabian Journal for Science and Engineering,* 42(3), 1013-1024 incorporated herein by reference in its entirety.

Upon studying signal phasing plans, signal timing, and left-lane length of isolated signalized intersections, two models were developed. See Yao, R., Zhou, H., & Ge, Y. E. (2017). Optimizing signal phase plan, green splits and lane length for isolated signalized intersections. *Transport,* 1-16, incorporated herein by reference in its entirety. A first model was intended to minimize intersection delays, and a second model was intended to maximize a ratio of intersection capacity to intersection delay. To do so, fixed allocation of lanes was assumed for all approaches. More specifically, two lanes were for left turning movement, one lane was for through movement, and one other lane was shared between right turning movement and through movement. A microscopic simulation tool (VISSIM) was used in the study to evaluate the performance of the four-legged intersection under different signal phase sequences. As a result, the effect of signal-phasing sequence on a signalized intersection performance was identified.

It is one object of the present disclosure to provide a method that varies signal timing according to different traffic movements. The method of the present disclosure, which can be, but is not limited to, being used at a four-legged intersection, collectively sets signal timing, intersection space (lane allocation) and phasing schemes. Signal time determination under a specific phasing scheme allocates signal timing to different traffic movements fairly under the constraints of fixed lane utilization.

SUMMARY OF THE INVENTION

A method of determining space allocation and signal timings of an isolated signalized intersection consists of at least one remote server that holds a plurality of traffic-related data of the isolated signalized intersection. The plurality of traffic-related data is accessed through a processing module, wherein the processing module can be, but is not limited to, a personal-computing (PC) device, is communicably coupled with the at least one remote server. As a first step, a space determination process is performed through the processing module to develop a phasing scheme and a lane allocation process. As a second step, a timing determination process is performed through the processing module. Based upon the results from the space determination process and the timing determination process, a cycle length for the isolated signalized intersection is determined through the processing module.

The method of the present disclosure emphasizes simplicity over complexity. Furthermore, the method of the present disclosure emphasizes on approximations over preciseness. The method described in the present disclosure can be implemented on a mobile device or any other comparable personal-computing (PC) device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

All illustrations of the drawings are for the purpose of describing selected versions of the present disclosure and are not intended to limit the scope of the present disclosure.

The method described in the present disclosure sets the space and time conditions of an isolated signalized intersection. Space is set by determining the number of lanes to be used by each movement (left, through and right) at each approach of different phases. Time is set by proportionately allocating green-light time of the isolated signalized intersection based upon the space determination process. In a preferred embodiment of the present disclosure, the green-light time is allocated according to the critical movement analysis of the Transportation Research Board (2010). See Roess, R. P., Prassas, E. S., & McShane, W. R. (2011). Traffic Engineering, USA, NJ, Englewood Cliffs:Prentice-Hall Transportation Research Board TRB, Highway Capacity Manual 2010. Washington, D.C., 2010, incorporated herein by reference in its entirety. When tested with varying traffic conditions, the average intersection delays resulting from the method of the present disclosure were better than the average intersection delays obtained from commercial programs. The method of the present disclosure can also be implemented as an added module to an existing commercial program to improve the results of the commercial program.

In order to fulfill the functionalities, the method of the present disclosure is provided with at least one remote server that comprises a plurality of traffic-related data of an isolated signalized intersection. In general, an intersection is a location where two or more roads carrying traffic streams in different directions intersect each other. The space common to all the lanes is referred to as the intersection. At a signalized intersection, the common space is periodically given to certain traffic flows while other conflicting traffic flows are barred from entry at that time. In particular, the common space is time-shared among various flows. In a preferred embodiment of the method described in the present disclosure, a single-ring structure is taken into consideration, wherein a ring is a term used to describe a series of conflicting phases that occur in an established order. However, in other embodiments of the method described in the present disclosure, dual-ring structures or multi-ring structures can also be considered.

Figure 1:
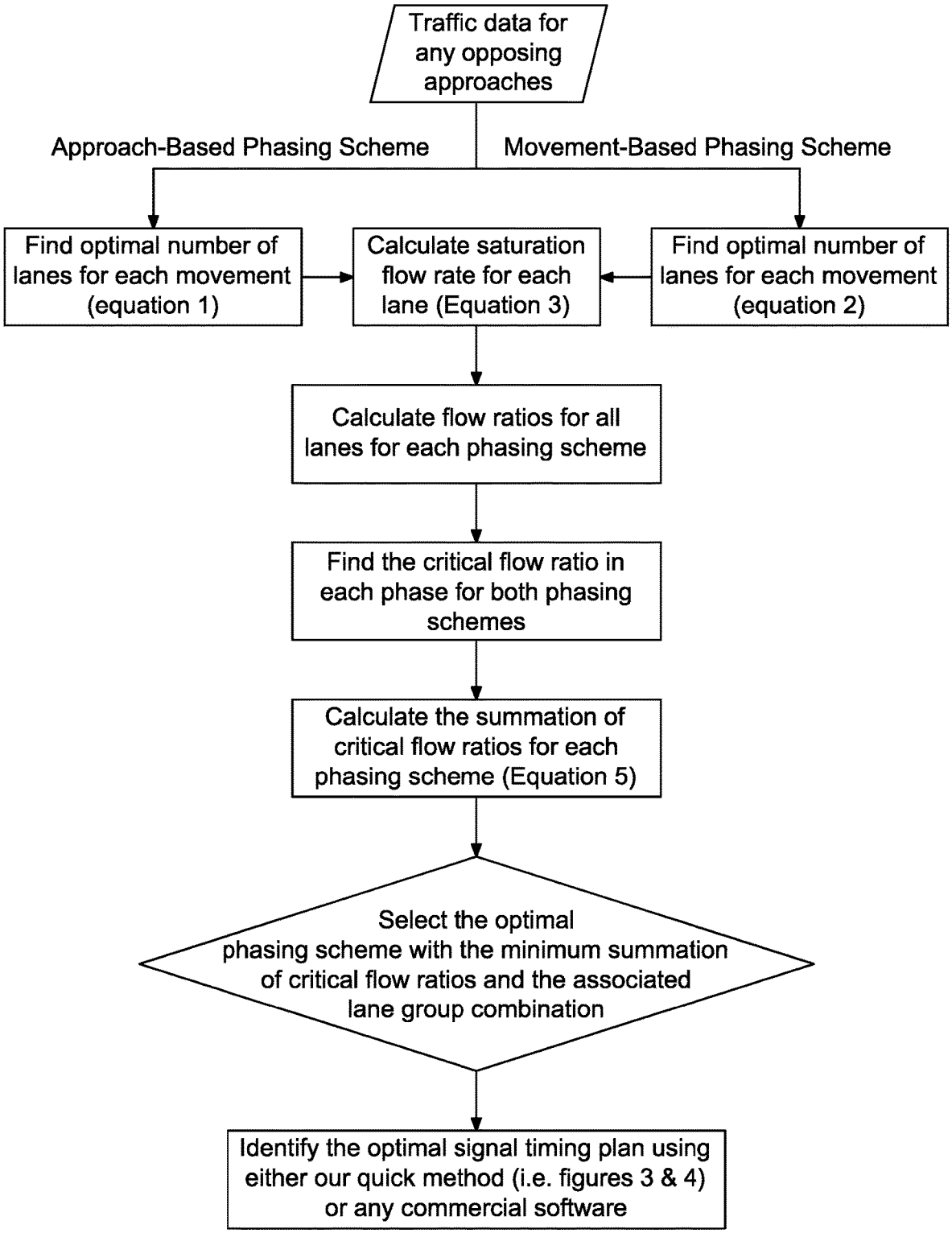
FIG. 1 is a flowchart illustrating the basic overall process of the method of the present disclosure.
Figure 2:
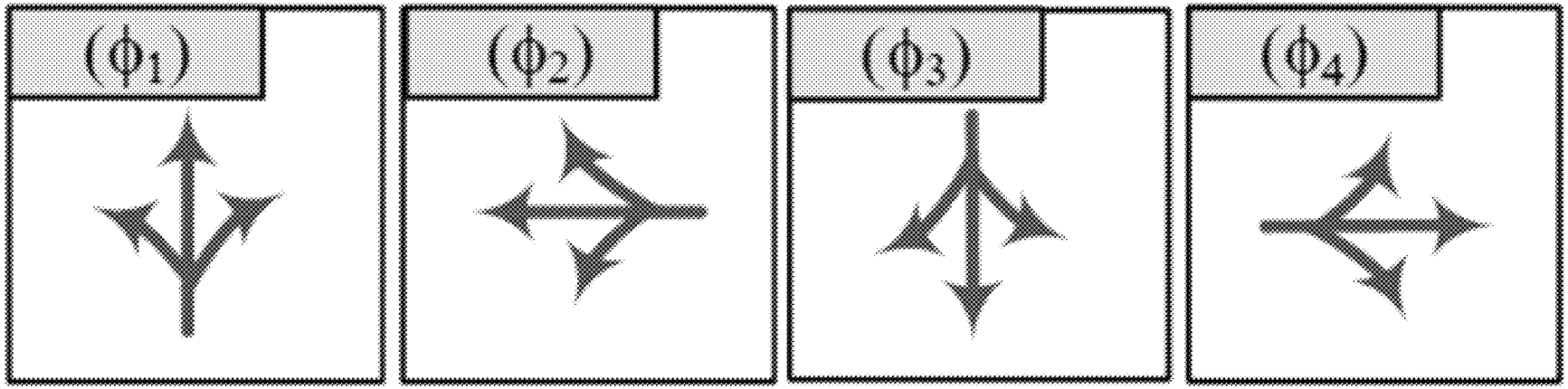
FIG. 2 is an illustration of an approach-based phasing scheme used in an isolated signalized intersection.
Figure 3:
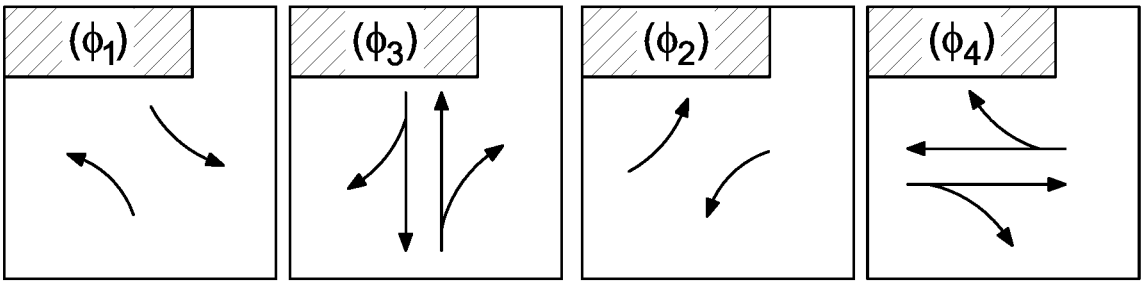
FIG. 3 is an illustration of a movement-based phasing scheme used in an isolated signalized intersection.
Figure 4A:
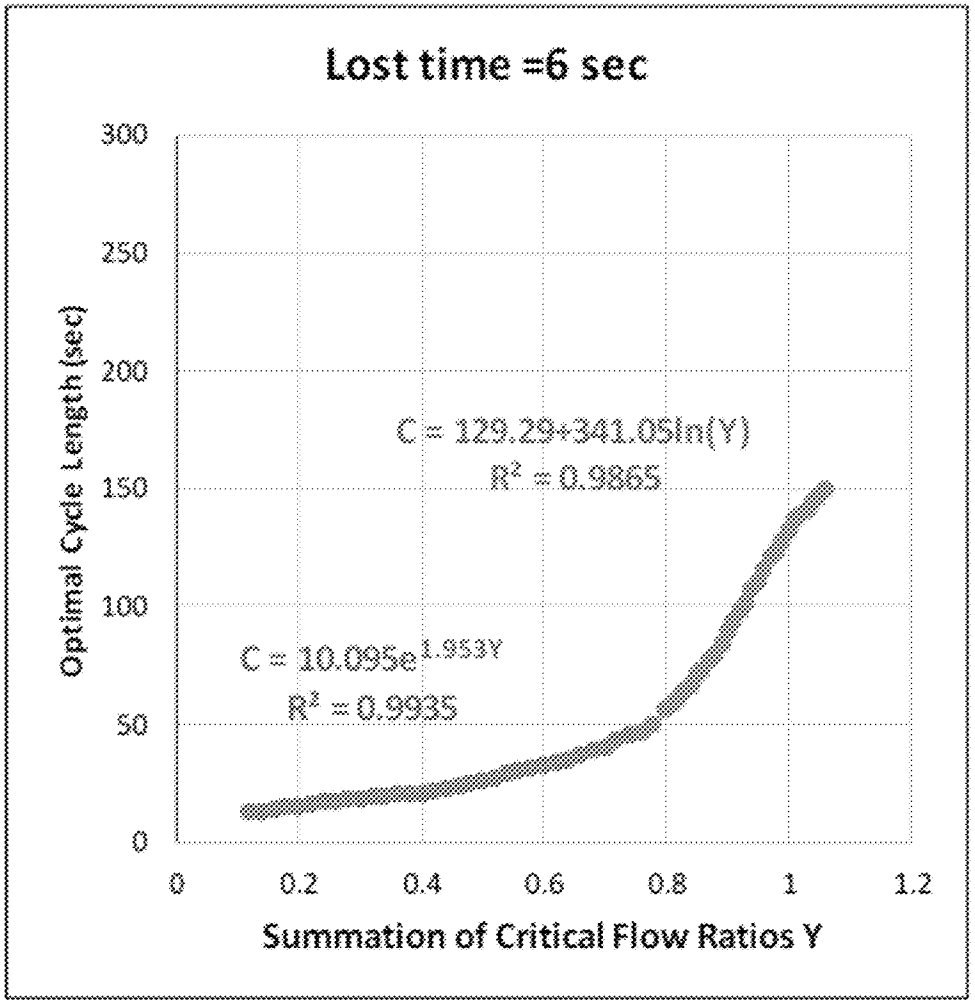
FIG. 4A is a graph illustrating the relationship between the cycle length and the summation of critical flows, wherein the lost time is 6-seconds(s).
Figure 4B:
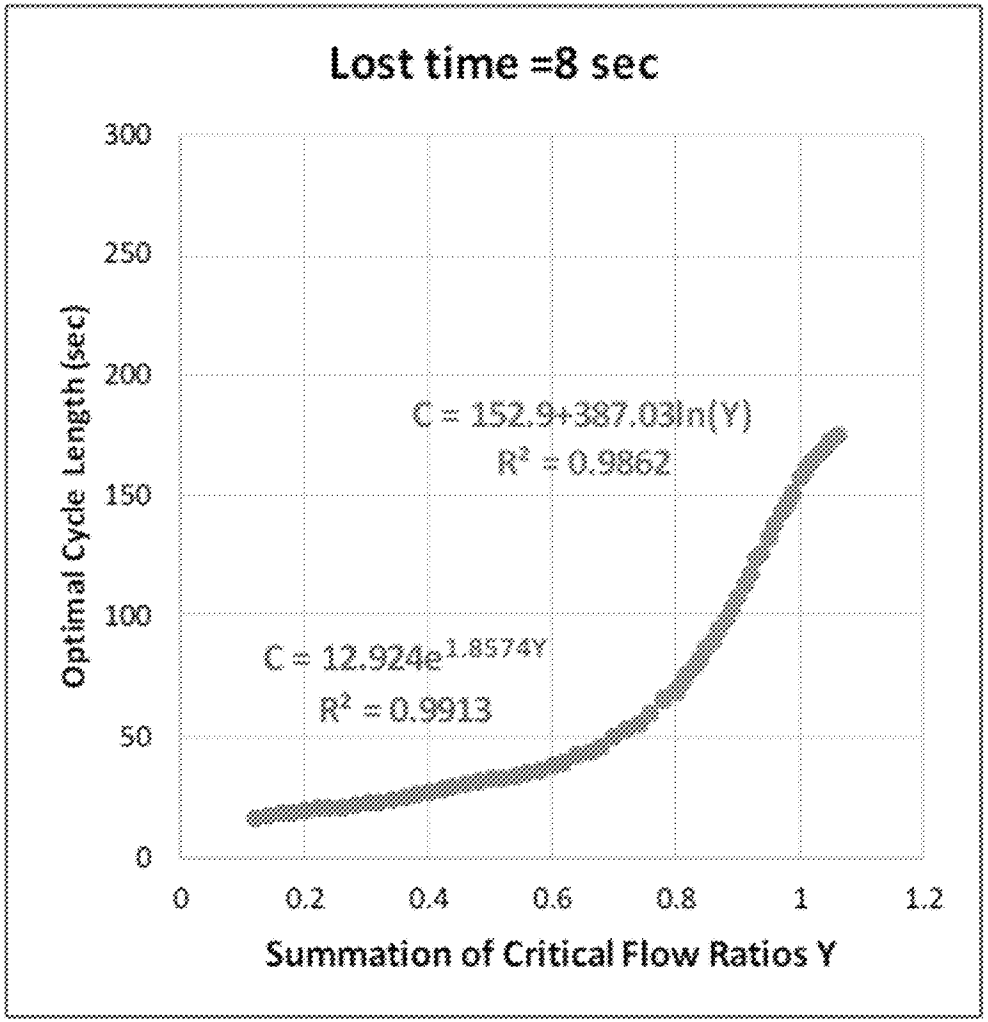
FIG. 4B is a graph illustrating the relationship between the cycle length and the summation of critical flows, wherein the lost time is 8 s.
Figure 4C:
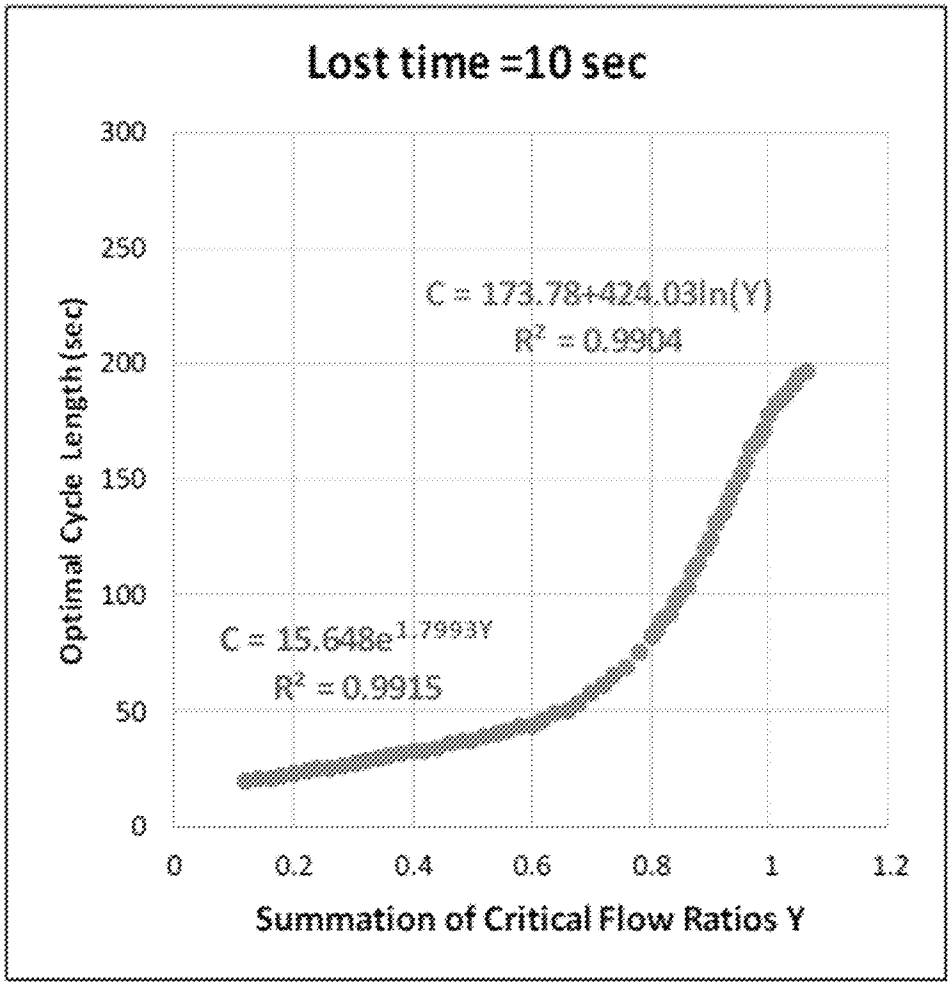
FIG. 4C is a graph illustrating the relationship between the cycle length and the summation of critical flows, wherein the lost time is 10 s.
Figure 4D:
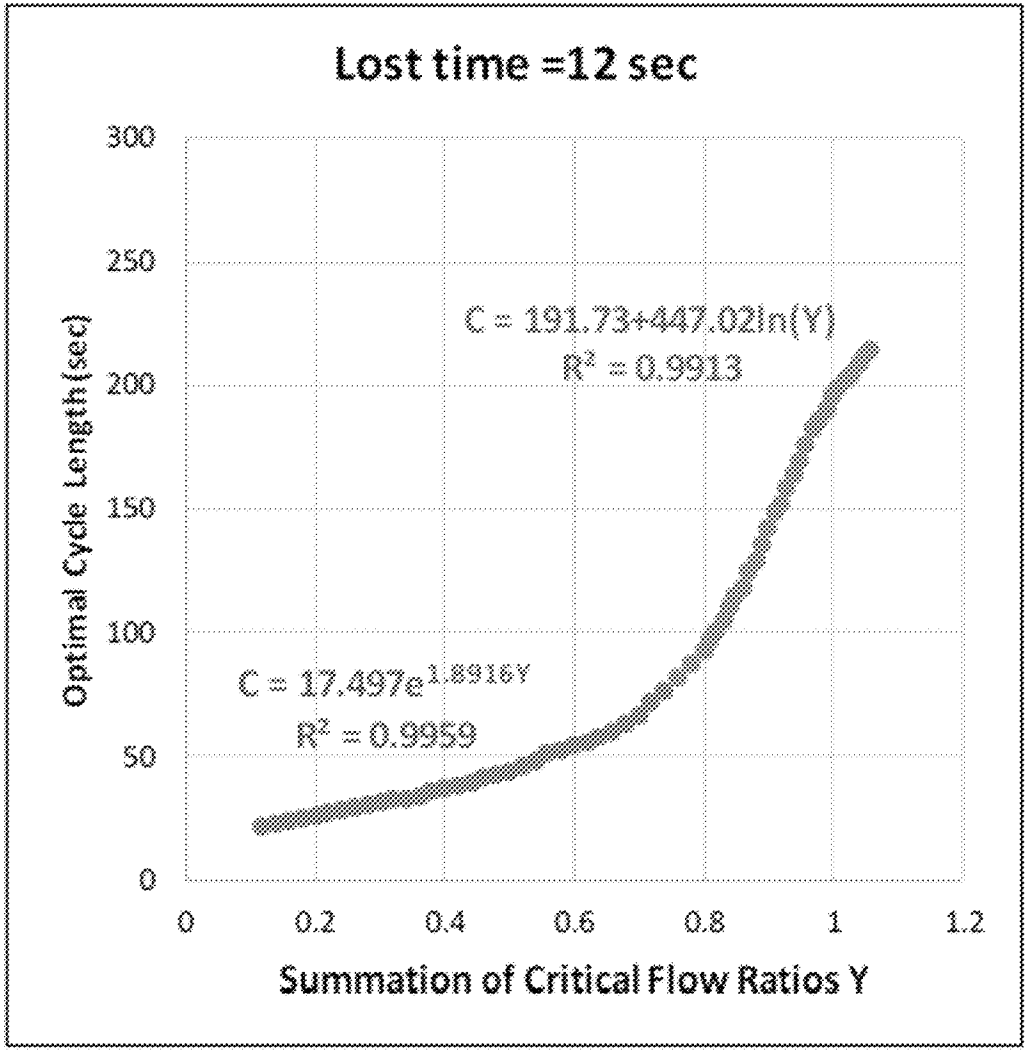
FIG. 4D is a graph illustrating the relationship between the cycle length and the summation of critical flows, wherein the lost time is 12 s.
Figure 5A:
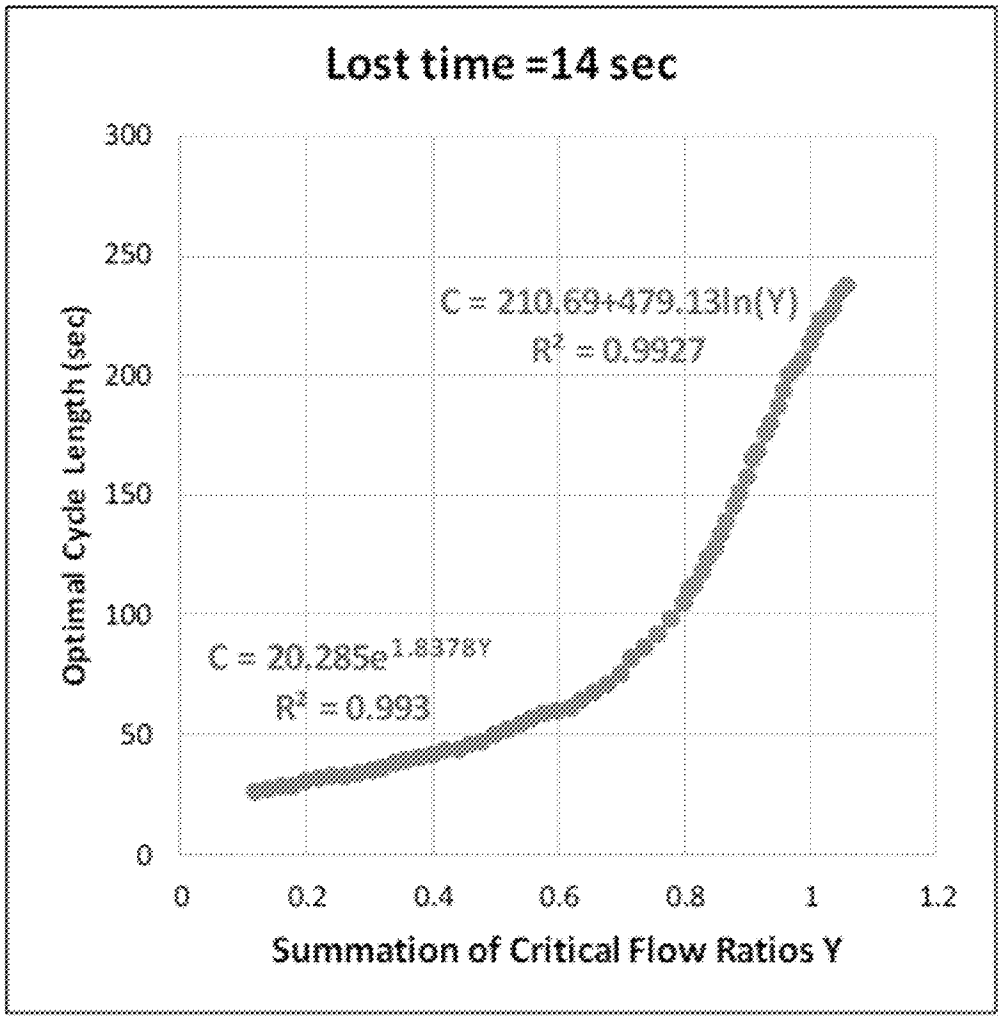
FIG. 5A is a graph illustrating the relationship between the cycle length and the summation of critical flows, wherein the lost time is 14 s.
Figure 5B:
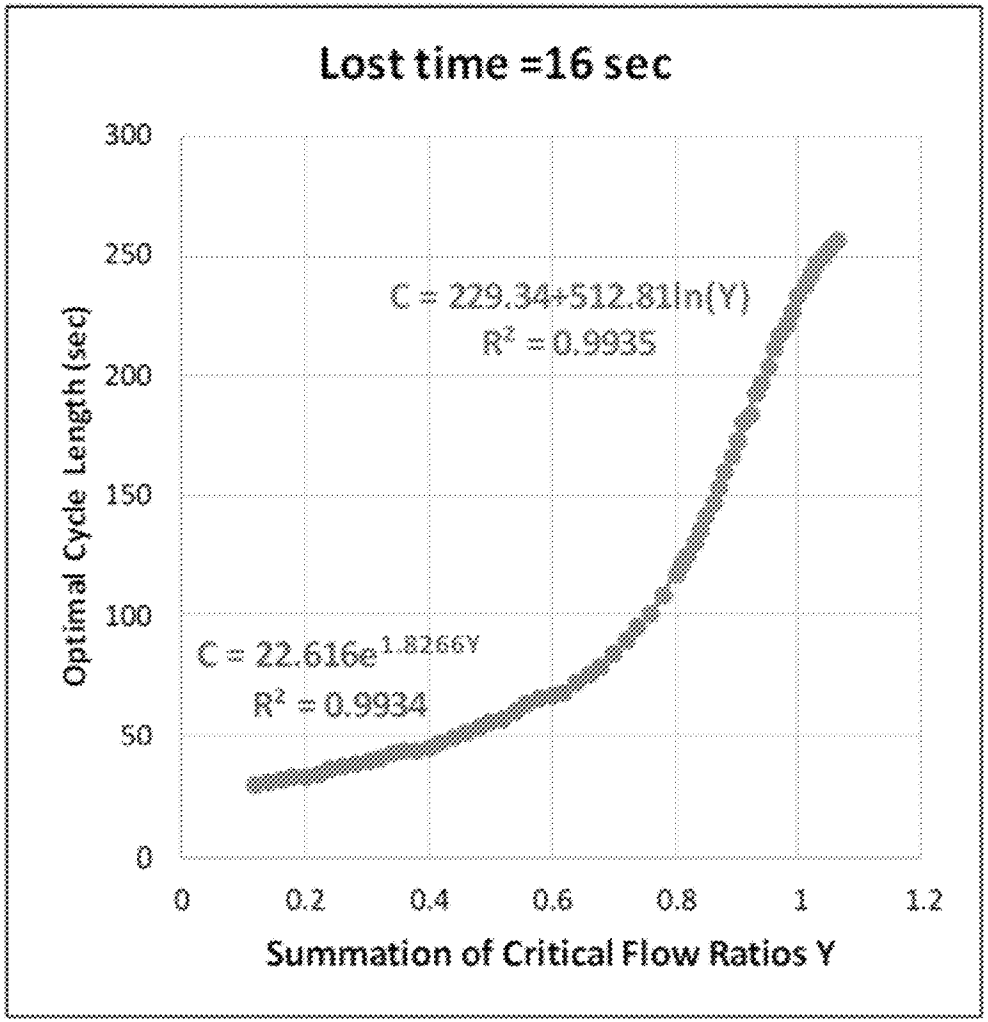
FIG. 5B is a graph illustrating the relationship between the cycle length and the summation of critical flows, wherein the lost time is 16 s.
Figure 5C:
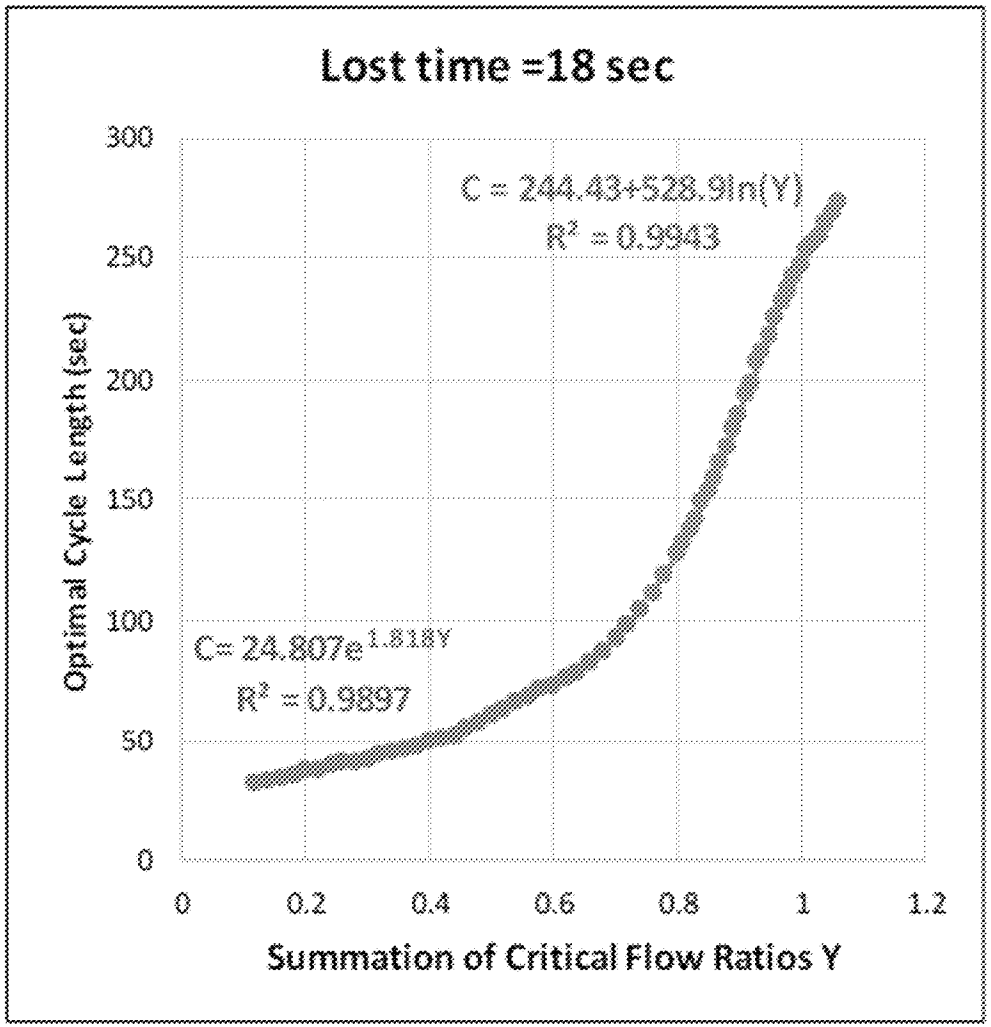
FIG. 5C is a graph illustrating the relationship between the cycle length and the summation of critical flows, wherein the lost time is 18 s.
Figure 5D:
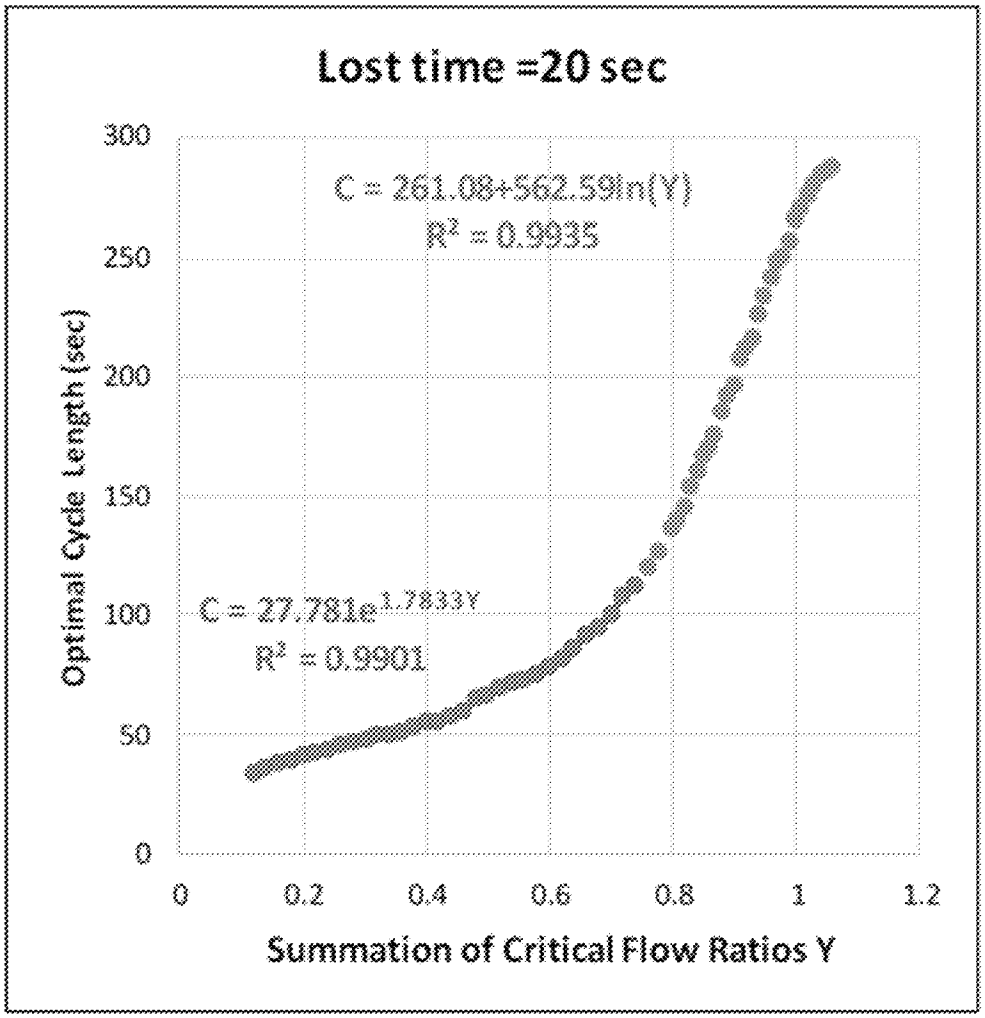
FIG. 5D is a graph illustrating the relationship between the cycle length and the summation of critical flows, wherein the lost time is 20 s.

The plurality of traffic-related data can be, but is not limited to, a volume of vehicles at the isolated signalized intersection, a list of peak hours, a list of off-peak hours, and a total green-light time. When the method of the present disclosure is being implemented, the plurality of traffic-related data is received through a processing module that can be, but is not limited to, a personal-computing (PC) device. To do so, the processing module represented by a PC device in a preferred embodiment is communicably coupled with the at least one remote server. As seen in FIG. 1, a space determination process is performed using the processing module for the plurality of traffic-related data through an approach-based phasing scheme and a movement-based phasing scheme. Next, based upon the results obtained from the space determination process, the processing module determines a timing determination process for the plurality of traffic-related data. According to the results obtained from the space determination process and the timing determination process, a signal operational schedule is determined. In particular, the processing module determines a cycle length for the isolated signalized intersection, wherein the space determination process and the timing determination process provide inputs to determine the cycle length. As described earlier, the cycle length is the time in seconds that it takes for a signal to complete one full cycle of indications. The cycle length indicates the time interval between the starting of green for one approach till the next green starts. Generally, cycle length is denoted by C.

In a preferred embodiment, the method described in the present disclosure is implemented at a four-legged intersection. However, in another embodiment, the method described in the present disclosure can be implemented at a three-legged intersection or other intersection with a different number of lanes. In particular, the method of the present disclosure can be used to determine the cycle length of any intersection with any number of legs.

As described earlier, the approach-based phasing scheme and the movement-based phasing scheme are used in the space determination process. During the space determination process, as a first assumption, all left turns are assumed to be fully protected as a requirement from local authorities to enhance safety. As a second assumption, right turns on red are assumed to be prohibited at the isolated signalized intersection.

When performing the space determination process, each of the opposing approaches at the isolated signalized intersections are considered separately. As an example, an east-west approach at an exemplary intersection is considered independent from a north-south approach at the exemplary intersection. Considering the opposing approaches independently gives an added degree of flexibility. For instance, if needed, an east-west approach can be considered under the approach-based phasing scheme and the north-south approach can be considered under the movement-based phasing scheme or vice versa. In certain circumstances, using a mix of the approach-based phasing scheme and the movement-based phasing scheme can lead to an increase in efficiency.

The isolated signalized intersection comprises a plurality of phases, wherein each of the plurality of phases represents the fundamental method by which the isolated signalized intersection accommodates the various users. In other words, a phase from the plurality of phases gives a sequence of individual signal phases or combinations within a signal cycle that define in which various pedestrian and vehicular movements are assigned the right-of-way. When the approach-based phasing scheme is used in the space determination process, the processing module calculates a set of flow rates for each phase of the plurality of phases. Each of the set of flow rates corresponds to a specific lane of the isolated signalized intersection.

In order to calculate a flow rate from the set of flow rates, the processing module receives a volume of traffic (v) for a specific movement/s of the isolated signalized intersection along with a saturation flow rate (s) for a specific lane serving the specific movement/s. Information related to volume of traffic at a given time is stored on the at least one remote server within the plurality of traffic-related data. The volume of traffic can vary based upon peak-hours and off-peak hours. Saturation flow rate, which is also stored within the plurality of traffic-related data, describes the number of vehicles in a dense flow of traffic for a specific intersection lane group. In other words, if an approach signal of a specific intersection was to stay green for an entire hour, and the flow of traffic through the specific intersection was as dense as could be expected, the saturation flow rate would be the amount of vehicles that pass through the specific intersection during that hour. The flow rate for the specific lane serving the specific movement/s is calculated as a ratio between the volume of traffic and the saturation flow rate.

When the set of flow rates is determined, the processing module determines a critical flow rate for each of the plurality of phases.

$$\text{Critical flow rate}=(v/s)_{critical}$$

In particular, the critical flow rate is the maximum flow rate of a selected phase from the plurality of phases. As an example, if the method described in the present disclosure is implemented at a four-legged intersection, the plurality of phases will consist of four phases, and each of the phases will have a respective critical flow rate. Thus, overall, there will be four critical flow rates. When the critical flow rate is determined for each of the plurality of phases, the processing module sums the critical flow rate of each of the plurality of phases to determine a first critical flow summation associated with the approach-based phasing mechanism. A summation of the critical flow rate can be represented as:

$$Y = \sum_{i=1}^{N}\left(\frac{v}{s}\right)_{critical} \qquad \text{Equation–6}$$

Where;

i—phase number;

N—number of phases;

In a preferred embodiment of the method described in the present disclosure, under the approach-based phasing scheme, each of the opposing approaches at the isolated signalized intersection is assumed to operate independently. Thus, the approach-based phasing scheme is applied to each approach separately and the following formulation is derived:

$$\text{MIN}\left|\frac{V_{a,1}}{N_{a,1}} - \frac{V_{a,2}}{N_{a,2}}\right| + \left|\frac{V_{a,1}}{N_{a,1}} - \frac{V_{a,3}}{N_{a,3}}\right| + \left|\frac{V_{a,2}}{N_{a,2}}\frac{V_{a,3}}{N_{a,3}}\right| \qquad \text{Equation–2}$$

-continued

Subject to:

$$N_{a,j} > 0$$

$$\sum_{j=1}^{3} N_{a,j} = N_a$$

Where;

j Turning movement at the approach. j=1, 2, 3 respectively representing left-turn movement, through movement, and right-turn movement a Intersection approach. a=1,2,3,4, respectively representing west approach, north approach, east approach, and south approach.

$N_a$ Total number of lanes at approach a $N_{a,j}$ Number of lanes for turning movement j at approach a $V_{a,j}$ Traffic volume of movement j at approach a When the movement-based phasing scheme is used for the plurality of phases, the processing module calculates a set of flow rates for each of the plurality of phases. Similar to the approach-based phasing scheme, each of the set of flow rates corresponds to a specific lane serving a specific movement of the isolated signalized intersection. From the set of flow rates, the processing module determines a critical flow rate for each of the plurality of phases, wherein the critical flow rate is the maximum flow rate from the set of flow rates. Next, the processing module sums the critical flow rate of each of the plurality of phases to determine a second critical flow summation associated with the movement-based phasing scheme.

In a preferred embodiment of the method described in the present disclosure, under the movement-based phasing scheme, two opposing approaches operate together as one unit. The two opposing approaches are usually served in two separate phases of the plurality of phases. In the movement-based phasing scheme, sharing left turning movement along with through movement is prohibited. Since only the left-turning lanes can be used for left-turning movement, the number of lanes designated for left-turning movement is an integer. The following formulation is derived for the isolated signalized intersection when the movement-based phasing scheme is implemented for the opposing approaches:

$$\text{MIN}\left|\frac{V_{a,1}}{N_{a,1}} - \frac{V_{a+2,1}}{N_{a+2,1}}\right| + \left|\frac{V_{a,2}+V_{a,3}}{N_{a,2}+N_{a,3}} - \frac{V_{a+2,2}}{N_{a+2,2}}\frac{V_{a+2,3}}{N_{a+2,3}}\right| \qquad \text{Equation–3}$$

Subject to:

$$N_{a,j} > 0$$

$N_{a,1}$ & $N_{a+2,1}$ are integers $$N_{a,1}, N_{a+2,1}, N_{a,2}, N_{a,3}, N_{a+2,2}, N_{a+2,3} < N_a$$

$$\sum_{j=1}^{3} N_{a,j} = N_a$$

$$\sum_{j=1}^{3} N_{a+2,j} = N_{a+2}$$

After the first critical flow summation and the second critical flow summation are determined, the processing module identifies a determined phasing scheme for the space determination process of the isolated signalized intersection. In order to do so, the first critical flow summation and the second critical flow summation are compared to each other through the processing module. A minimum critical flow summation resulting from the comparison is determined to be associated with the determined phasing scheme that is most suitable for the isolated signalized intersection. Based upon the traffic at the isolated signalized intersection, either the approach-based phasing scheme or the movement-based phasing scheme can be the determined phasing scheme. As an example, if the first critical flow summation is smaller than the second critical flow summation, the approach-based phasing scheme is the determined phasing scheme. On the other hand, if the second critical flow summation is smaller than the first critical flow summation, the movement-based phasing scheme is the determined phasing scheme. An objective of the determined phasing scheme as part of the space determination process is to minimize the difference between vehicle volumes per lane over all lanes that will be served in a specific phase. By doing so, the unused green time of the isolated signalized intersection is minimized. Since the number of lanes resulting from the phasing scheme depends on the vehicle volumes and the phasing scheme used, both the approach-based phasing scheme and the movement-based phasing scheme needs to be examined separately.

For simplicity and consistency, all volumes taken into consideration in equation-2 and equation-3 are the equivalent through traffic volumes of a specific lane of a specific phase of the isolated signalized intersection. More specifically, in both the approach-based phasing scheme and the movement-based phasing scheme, a through-traffic volume is considered. In order to represent a turning-traffic volume in equation-2 and equation-3, the turning-traffic volume is scaled by an equivalent factor. The equivalent factor is determined as a ratio between a saturation flow rate of through traffic and a saturation flow rate of turning traffic. The through-traffic volume, the turning-traffic volume, the saturation flow rate of through traffic, and the saturation flow rate of turning traffic are stored on the at least one remote server and is accessible through the processing module. Moreover, the saturation flow rate for turning traffic is obtained through the following formula:

$$S_{a,k} = \frac{\overline{S}_{i,k}}{1 + 1.5\sum_{j=1}^{j=3}\left(\frac{f_{a,k,j}}{r_{a,k,j}}\right)} \quad \text{Equation–4}$$

Where;

$S_{a,k}$: Saturation flow rate of lane k at approach a;

$\overline{S}_{i,k}$: Saturation flow rate for straight movement (assumed to be 1900 veh/hr);

$r_{a,k,j}$: Turning radius for movement j (=∞ for straight-ahead movement);

$f_{a,k,j}$: flow factor: the proportion of movement j at lane k of approach i from total traffic at lane k as shown in the following:

$$f_{a,k,j} = \frac{V_{a,k,j}}{\sum_{j=1}^{j=3} v_{a,k,j}} \quad \text{Equation–5}$$

Where;

$V_{a,k,j}$: the traffic demand of movement j via lane k at approach a.

See Zhang et al. (2012); and Kimber, R. M., McDonald, M., & Hounsell, N. B. (1986). The prediction of saturation flows for road junctions controlled by traffic signals. Transport and Road Research Laboratory RESEARCH REPORT, (67), each incorporated herein by reference in their entirety.

When equation-4 was applied to a four-legged intersection, the saturation flow rate for left turns was 1690 vehicles/hour (veh/h). Thus, the equivalent factor for left turns is given by the following:

1900/1690=1.12

When equation-4 was applied to a four-legged intersection, the saturation flow rate for right turns was 1652 vehicles/hour. Thus, the equivalent factor for right turns is given by the following:

1900/1652=1.15

After the method of the present disclosure completes the space determination process, where the determined phasing scheme and the lane allocation are found, the method of the present disclosure proceeds to perform the timing determination process.

The timing determination process requires identifying a cycle length for the isolated signalized intersection. The process of identifying the cycle length is a lengthy iterative process of testing all possible cycles within a specific range and determining a cycle length that satisfies a specific objective function. In a preferred embodiment of the method described in the present disclosure, the objective function is to minimize an average intersection delay through the timing process. The average estimation delay per vehicle is estimated through the proposed methodology in the Highway Capacity Manual (HCM) of the Transportation Research Board 2010. The average control delay per vehicle is given by the following:

Equation-7:

$$d_{a,k} = d_{1,a,k}(PF) + d_{2,a,k} + d_{3,a,k} \quad (7)$$

Where;

$d_{a,k}$: control delay per vehicle (sec);

$d_{1,a,k}$: uniform control delay assuming uniform arrivals for lane k of approach a (sec);

PF: progression adjustment factor, assumed to be 1;

$d_{2,a,k}$: average delay per vehicle owing to random arrivals for lane k of approach a, which is called incremental delay (sec).

$d_{3,a,k}$: average delay per vehicle owing to an initial queue at the start of the analysis period for lane k of approach a (sec).

The average control delay for lane k at approach a owing to uniform intervals is estimated according to the following formula (Transportation Research Board 2010):

$$d_{1,a,k} = \frac{0.5C\left(1 - \frac{g_i}{C}\right)^2}{1 - \left[\min(1, x_{a,k}) \cdot \frac{g_i}{C}\right]} \quad \text{Equation–8}$$

Where;

C: cycle length (sec);

$g_i$: effective green time for lane group (sec);

$x_{i,k}$: total lane volume-to-capacity ratio (v) for lane k, where $$c_{i,k} = S_{i,k}\left(\frac{g_i}{c}\right).$$

The incremental delay $d_2$ is estimated following equation-9.

$$d_{2,a,k} = 900T\left((x_{a,k} - 1) + \sqrt{(x_{a,k} - 1)^2 + \frac{8k_f I x_{a,k}}{c_{a,k} T}}\right) \quad \text{Equation-9}$$

Where;

T: duration of analysis period (h);

$k_f$: incremental delay factor;

I: upstream filtering/metering adjustment factor;

$c_{a,k}$: lane capacity (veh/h).

As the timing determination process is performed for the isolated signalized intersection, the value of the upstream filtering/metering adjustment factor (I) is assumed to be 1. Moreover, the value of the incremental delay factor $k_f$ is assumed to be 0.5 since the signal operation is not actuated as recommended by the HCM (Transportation Research Board 2010). For simplification purposes, it is assumed that no initial queue delay exist from the previous analysis period. Thus, $d_3$=0. See Cheng et al. 2003; and Ding, J., Zhou, H., & Yao, R. (2014). Optimization of lane use and signal timing for isolated signalized intersections with variable lanes. In *CICTP* 2014: *Safe, Smart, and Sustainable Multimodal Transportation Systems* (pp. 2012-2024), each incorporated herein by reference in their entirety.

In order to find the cycle length as an output of the timing determination process based upon the input from the space determination process, a brute force-hill climbing algorithm is developed in MATLAB, wherein the brute force-hill climbing algorithm generates a solution by considering all possibilities until a recognizable solution is reached. In a preferred embodiment of the method described in the present disclosure, a maximum cycle length is assumed to be 300-seconds(s). Moreover, considering a minimum lost time per phase, a minimum cycle length of 10 s is assumed. Thus, the investigated cycle length range is within a range of 10 s-300 s. However, in other embodiments of the method described in the present disclosure, the investigated cycle range can vary. The lost time is defined as the time, in seconds, during which an intersection is not used effectively by any movement. For any signalized intersection phase where one or more traffic movements are initiated, lost time is generally considered to be equivalent to the sum of the yellow plus all-red intervals at the end of the phase.

As seen in FIGS. 4A-5D, the relationship between the cycle length and the summation of critical flow rates (Y) is investigated for different values of Y between 0.1 and 1.10. In this instance, Y=0.1 corresponds to a free flow condition and a Y=1.1 corresponds to a congested condition. Thus, the range of 0.1 to 1.1 is applicable to a wide variety of circumstances that can occur at the isolated signalized intersection. Intersections having Y values below 0.1 generally do not require signalization. When the value of Y exceeds 1.1, the principle of metering is used rather than signalization since delay estimations are generally not practical when Y>1.1. Within the range of 0.1 and 1.1, the value of Y is incremented by 0.01. In a preferred embodiment of the present disclosure, eight values of total lost time (L) with each value of Y are also investigated. Even though eight values of total lost time (L) are considered in a preferred embodiment, a different number of values can be investigated for the total lost time (L) in a different embodiment of the method described in the present disclosure. The total lost time (L) at the isolated signalized intersection is defined as the summation of start-up lost time and clearance lost time. See Roess, R. P., Prassas, E. S., & McShane, W. R. (2011). Traffic Engineering, USA, N.J., Englewood Cliffs:Prentice-Hall Transportation Research Board TRB, Highway Capacity Manual 2010. Washington, D.C., 2010, incorporated herein by reference in its entirety. As described earlier, the summation of critical flow rates (Y) is given by equation-6:

$$Y = \sum_{i=1}^{N} \left(\frac{v}{s}\right)_{critical}$$

A green light time for each phase of the plurality of phases is calculated through a time budget concept wherein a total effective green light time is distributed among the each of the phases based upon the critical flow rate of each phase. In particular, if the determined phasing scheme is obtained through the approach-based phasing scheme, a corresponding green light time is allocated to each of the plurality of phases according to the critical flow rate. Likewise, if the determined phasing scheme is obtained through the movement-based phasing scheme, a corresponding green light time is allocated to each of the plurality of phases according to the critical flow rate.

In a preferred example, twenty different hypothetical turning volume combinations were randomly generated to produce a selected value of Y, wherein Y is within the range of 0.1 and 1.10. Next, all cycle lengths within the investigated range of 10 s-300 s were attempted on each of the twenty different hypothetical turning volume combinations. Next, the cycle length for each combination resulting in the minimum average intersection delay was recorded. The results proved that a maximum difference among twenty values of cycle lengths corresponding to the selected Y is less than 10 s, wherein the twenty values were selected to be within the range of 10 s-300 s. Thus, the cycle length seems to be dependent on the value of Y and not on the through traffic volume and the turning traffic volume producing the value of Y. In order to fund the cycle length for any value of Y, an average of the twenty cycle lengths is considered.

As seen in FIGS. 4A-5D, the results obtained in the preferred example show that the relationship between the cycle length and Y starts changing from exponential to logarithmic when Y is substantially equal to 0.74. Therefore, one equation was developed to describe the exponential relationship between the cycle length and Y for each value of lost time. Another equation was developed to describe the logarithm relationship between the cycle length and Y for each value of lost time. In particular, exponential equations were developed to be used when Y≤0.74 and logarithmic equations were developed to be used when Y>0.74. The substantially high values obtained for coefficients of determination $R^2$ indicate that the variations in the cycle length can be explained using Y. When two equations were derived to represent both the exponential behavior and the logarithmic behavior, an overall prediction capability of the cycle length degraded. In particular, the degradation was more significant when representing the logarithmic behavior.

In order to test the accuracy of the method described in the present disclosure a hypothetical data set was used. The hypothetical data set is different from the twenty different hypothetical turning volume combinations used in developing the calculation modules related to the method of the present disclosure. For testing purposes, a data set of 300 volume combinations was generated randomly. Next, for each of the 300 turning volume combinations, the cycle length was found using the brute force-hill climbing algorithm in MATLAB. The cycle length obtained from the hypothetical data set was compared with the results from the preferred example. A ratio between the cycle length obtained from the hypothetical data set and the cycle length obtained in the preferred example are used to calculate an error value of the cycle length obtained from the hypothetical data set with 300 turning volume combinations. The error value ranged from 0% to 7.6% with an average of 2.2% and a standard deviation of 1.6%. The percentage error results provide substantially conclusive evidence that the method of the present disclosure can produce the cycle length times quicker than conventional methods such as the hill-climbing algorithm in MATLAB which needs more execution time.

In a preferred implementation of the method described in the present disclosure, the isolated signalized intersection is a four-legged intersection in Dharan City, Saudi Arabia. In this instance, the isolated signalized intersection is subjected to tidal flow during the day and operates under an approach-based phasing scheme with four phases and a total lost time of 20-seconds.

Figure 6:
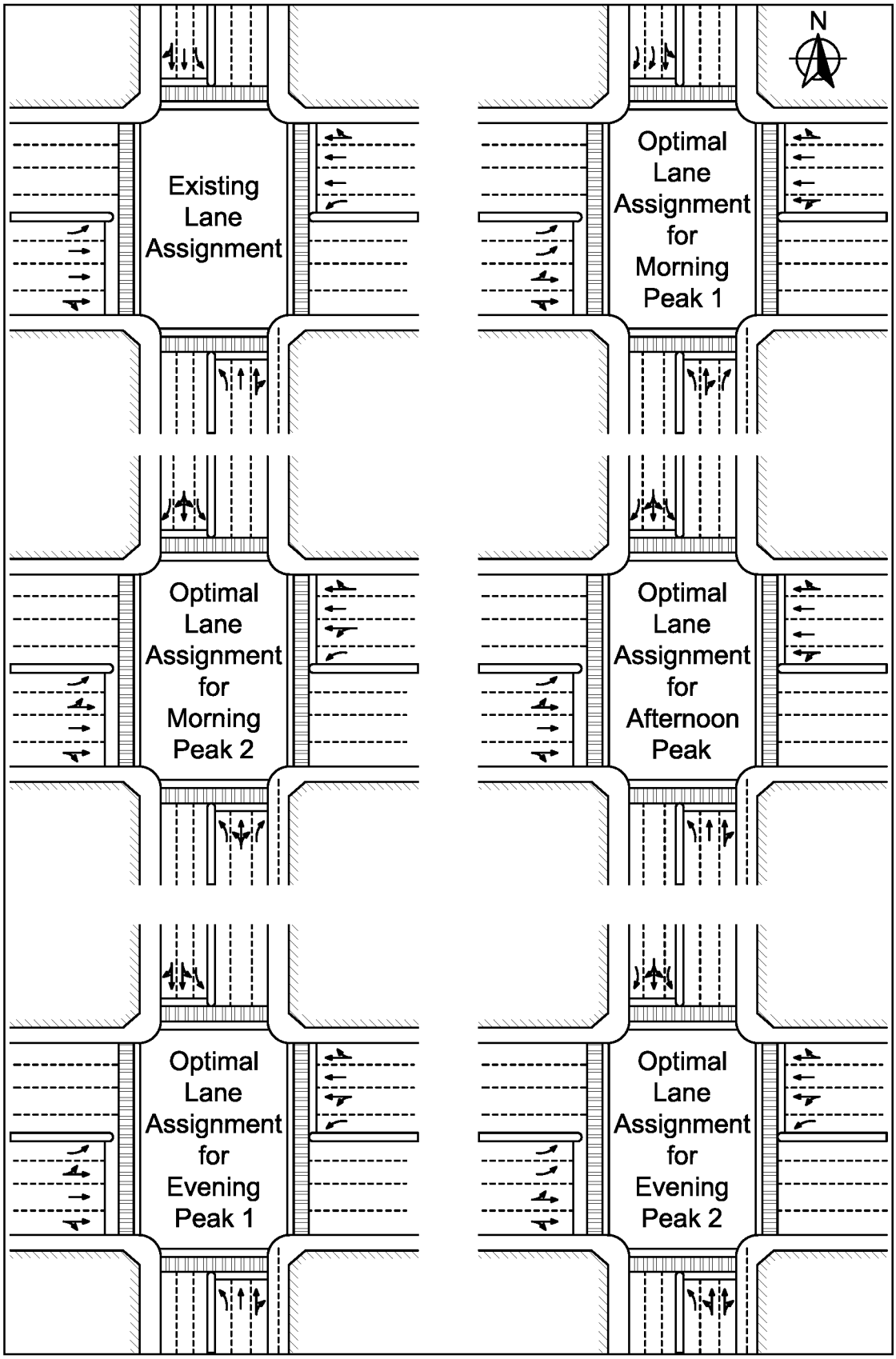
FIG. 6 is an illustration of an isolated signalized intersection, wherein the existing lane assignment and the lane assignment obtained through the method of the present disclosure is illustrated.

The hourly turning movement volumes of left turning movement, through movement, and right turning movement were collected at all approaches of the isolated signalized intersection for 24-hours consecutively. Moreover, as illustrated in FIG. 6, the isolated signalized intersection of the preferred implementation consists of five peak hours distributed as two morning peak hours, one afternoon peak hour, and two evening peak hours.

The method described in the present disclosure was evaluated over five peak hours, to evaluate the effectiveness of using the method of the present disclosure to determine space, specifically through phasing schemes and lane allocations. Macroscopic software that can be, but is not limited to TRANSYT-7F, Synchro, and HCS2010 were used during the evaluation process. TRANSYT-7F and Synchro models are generally known to be calibrated for the study area and are frequently used by local research and practitioners. The Highway Capacity Manual (HCM2010) and associated software HCS2010 are well known and acceptable standard tools in the study area of traffic signal design and analysis.

As a first step of the evaluation process, a signal-timing plan is developed using TRANSYT-7F with the existing phasing scheme and lane utilization. Next, the method described in the present disclosure is used to develop the phasing scheme and lane utilization for the isolated signalized intersection. When the phasing schemes and the lane utilizations are determined, TRANSYT-7F is used to obtain the cycle length of the isolated signalized intersection. Next, the delay resulting from the phasing obtained through TRANSYT-7F is compared with the delay resulting from the phasing from the method of the present disclosure. The difference in delays shows that there is a considerable benefit in utilizing the method introduced in the present disclosure. As seen in Table 1, a reduction of 78% to 92% with an average of 87% in average intersection delay was seen. The same comparison was repeated using HCS2010 which resulted in a reduction between 68% and 88% with an average of 81%. Repeating this comparison using Synchro, produced a reduction ranging between 54% and 70% with an average of 64%. It is clear that setting space and timing together yields significant reductions in average intersection delays. Table 2 shows performance comparisons between the proposed complete model (capable of optimizing space utilization, phasing scheme, and signal timing) and the available commercial tools that optimize timing only. The comparisons were based on the average intersection delay resulting from SimTraffic, which is a microscopic simulation tool. SimTraffic was used as a common simulation yardstick between the developed model and other commercial programs for fairness and objectivity. It is clear from Table 2 that the developed optimal solution is superior in terms of average intersection delay compared to the optimal plan produced by TRANSYT-7F. The reduction in delay was between 48% and 86% with an average of 71%. Redoing the comparison using HCS2010 produced a reduction in delay between 53% and 83% with an average of 75%. SYNCHRO was also tried and produced similar results, namely, the delay reduction ranged between 35% and 84% with an average of 67%. Consequently, the proposed model for space and time optimization consistently provided better results regarding average intersection delays compared to the commercial models tested.

TABLE 1

TRANSYT-7F Average Intersection Delay with the Optimal Transyt-7F Timing Plan and the Effect of the Space Optimization

| Peak hour (Total intersection volume veh/h) | Optimal TRANSYT-7F timing plan with existing lane allocation Sec/veh (optimal Cycle length s) | *Developed optimal space utilization with optimal TRANSYT-7F timing plan Sec/veh (optimal Cycle length s) | % Reduction in delay |
|---|---|---|---|
| Morning Peak1 (3547) | 281.50 (202) | 23.50 (47) | 91.7% |
| Morning Peak2 (3641) | 103.40 (158) | 23.0 (43) | 77.8% |
| Afternoon Peak (4494) | 348.90 (210) | 42.40 (80) | 87.8% |
| Evening Peak1 (4991) | 373.40 (196) | 31.90 (95) | 91.4% |
| Evening Peak2 (4506) | 407.80 (168) | 47.70 (84) | 88.3% |

*Optimization of space was conducted using our developed models

TABLE 2

SimTraffic simulation of average intersection delay for the proposed process and TRANSYT-7F

| Peak hour | Optimal TRANSYT-7F timing plan with existing lane allocation Sec/veh (optimal Cycle length, sec) | Developed optimal space utilization with developed optimal timing plan Sec/veh (optimal Cycle length, sec) | % Reduction in delay |
|---|---|---|---|
| Morning Peak1 | 122.50 (202) | 49.3 (52) | 60% |
| Morning Peak2 | 58.60 (158) | 30.4 (51) | 48% |
| Afternoon Peak | 254.20 (210) | 50.20 (79) | 80% |
| Evening Peak1 | 371.20 (196) | 53.80 (92) | 86% |
| Evening Peak2 | 272.70 (168) | 46.50 (84) | 83% |
| Average | | | 71% |

In the present disclosure, processes were developed for determining space, wherein the space was determined through phasing schemes and lane allocations, and timing plans of an isolated signalized intersection. In the space determination stage, an approach-based phasing scheme and a movement-based phasing scheme were used and the phasing scheme that results in the minimum summation of critical flow rates was selected as the determined phasing scheme for a specific turning volume combination. As described earlier, the critical flow rate is the maximum flow rate of a specific lane within a corresponding phase. When the spacing process is complete, the timing determination process is performed to minimize average intersection delay.

A first set of equations was developed for exponential behavior and a second set of equations was developed for logarithmic behavior to describe the relationship between the cycle length and the summation of critical flow rates (Y) for eight values of total lost time. The first set of equations corresponding to the exponential behavior is for $Y \leq 0.74$. The second set of equations corresponding to the logarithmic behavior is for $Y > 0.74$.

Next, a hypothetical set of 300 turning volume combinations were tested, where for each turning volume combination the cycle length was found using the brute force-hill climbing algorithm in MATLAB. The results from the brute force-hill climbing algorithm were compared to the results obtained through the method described in the present disclosure. The error ranged from 0%-12.4% with an average of 2.4%.

The results prove that regardless of the tool used for timing plan determination, determining space allocation and the timing plan together always yields significant reductions in average intersection delay when compared to average intersection delay obtained from only determining the timing plan. Previous studies in the field that found that setting the phasing scheme, lane allocations, and the timing plan independently may be beneficial. See Zhang & Wu 2012; Alhajyaseen, W. K., Ratrout, N. T., Assi, K. J., & Hassan, A. A. (2017). The Integration of Dynamic Lane Grouping Technique and Signal Timing Optimization for Improving the Mobility of Isolated Intersections. *Arabian Journal for Science and Engineering,* 42(3), 1013-1024; Yao et al. 2017; and Zhao, J., Ma, W., Zhang, H., & Yang, X. (2013). Two-step optimization model for dynamic lane assignment at isolated signalized intersections. *Transportation Research Record: Journal of the Transportation Research Board,* (2355), 39-48, each incorporated herein by reference in their entirety. However, previous studies did not focus using a space determination process and a timing plan determination process together as in the method of the present disclosure.

In another embodiment of the method described in the present disclosure, phasing schemes that use the principles of leading/lagging green, multiple rings design, and phase skipping can be addressed to further minimize intersection delay. The method described in the present disclosure can also be developed to be used as a mobile application on a mobile device that has an operating system that can be, but is not limited to, iOS and Android. Overall, a set of results obtained for average intersection delay by implementing the method described in the present disclosure is better than a set of results obtained for average intersection delay by implementing existing commercial programs. Moreover, the method of the present disclosure can also be implemented as an added module to existing commercial programs such that the results obtained from the existing commercial programs are improved.

Figure 7:
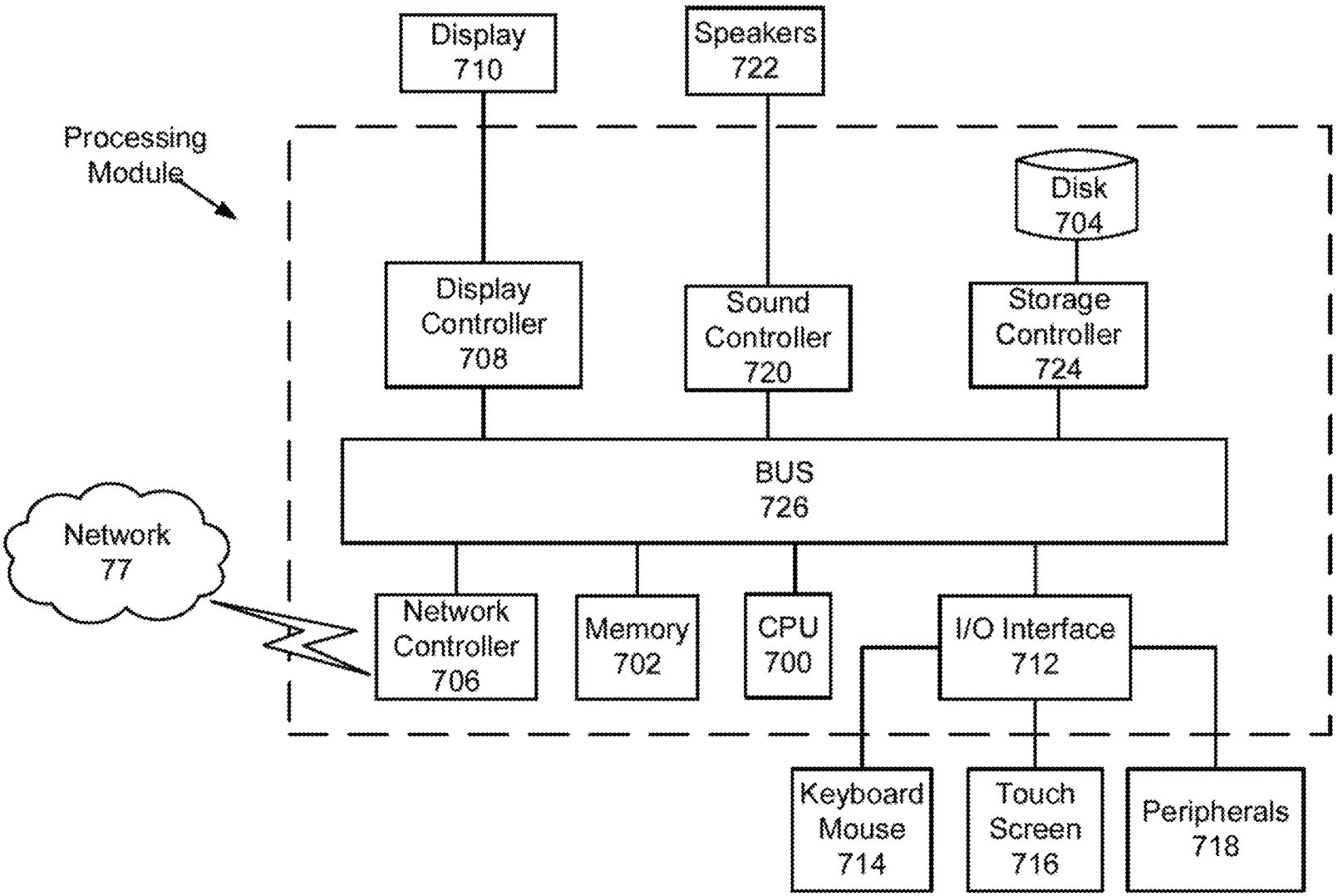
FIG. 7 is an illustration of a non-limiting example of details of computing hardware used in the computing system, according to certain embodiments.

Next, a hardware description of the processing module according to exemplary embodiments is described with reference to FIG. 7. In FIG. 7, the processing module includes a CPU 700 which performs the processes described above/below. The process data and instructions may be stored in memory 702. These processes and instructions may also be stored on a storage medium disk 704 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the processing module communicates, such as a server or computer.

Further, the claimed advancements may be provided as a utility application, background daemon, or component of an operating system, or combination thereof, executing in conjunction with CPU 700 and an operating system such as Microsoft Windows 7, UNIX, Solaris, LINUX, Apple MAC-OS and other systems known to those skilled in the art.

The hardware elements in order to achieve the processing module may be realized by various circuitry elements, known to those skilled in the art. For example, CPU 700 may be a Xenon or Core processor from Intel of America or an Opteron processor from AMD of America, or may be other processor types that would be recognized by one of ordinary skill in the art. Alternatively, the CPU 700 may be implemented on an FPGA, ASIC, PLD or using discrete logic circuits, as one of ordinary skill in the art would recognize. Further, CPU 700 may be implemented as multiple processors cooperatively working in parallel to perform the instructions of the inventive processes described above.

The processing module in FIG. 7 also includes a network controller 706, such as an Intel Ethernet PRO network interface card from Intel Corporation of America, for interfacing with network 77. As can be appreciated, the network 77 can be a public network, such as the Internet, or a private network such as an LAN or WAN network, or any combination thereof and can also include PSTN or ISDN subnetworks. The network 77 can also be wired, such as an Ethernet network, or can be wireless such as a cellular network including EDGE, 3G and 4G wireless cellular systems. The wireless network can also be WiFi, Bluetooth, or any other wireless form of communication that is known.

The processing module further includes a display controller 708, such as a NVIDIA GeForce GTX or Quadro graphics adaptor from NVIDIA Corporation of America for interfacing with display X10, such as a Hewlett Packard HPL2445w LCD monitor. A general purpose I/O interface 712 interfaces with a keyboard and/or mouse 714 as well as a touch screen panel 716 on or separate from display 710. General purpose I/O interface also connects to a variety of peripherals 718 including printers and scanners, such as an OfficeJet or DeskJet from Hewlett Packard.

A sound controller 720 is also provided in the processing module, such as Sound Blaster X-Fi Titanium from Creative, to interface with speakers/microphone 722 thereby providing sounds and/or music.

The general purpose storage controller 724 connects the storage medium disk 704 with communication bus 726, which may be an ISA, EISA, VESA, PCI, or similar, for interconnecting all of the components of the processing module. A description of the general features and functionality of the display 710, keyboard and/or mouse 714, as well as the display controller 708, storage controller 724, network controller 706, sound controller 720, and general purpose I/O interface 712 is omitted herein for brevity as these features are known.

The exemplary circuit elements described in the context of the present disclosure may be replaced with other elements and structured differently than the examples provided herein. Moreover, circuitry configured to perform features described herein may be implemented in multiple circuit units (e.g., chips), or the features may be combined in circuitry on a single chipset, as shown on FIG. 8.

Figure 8:
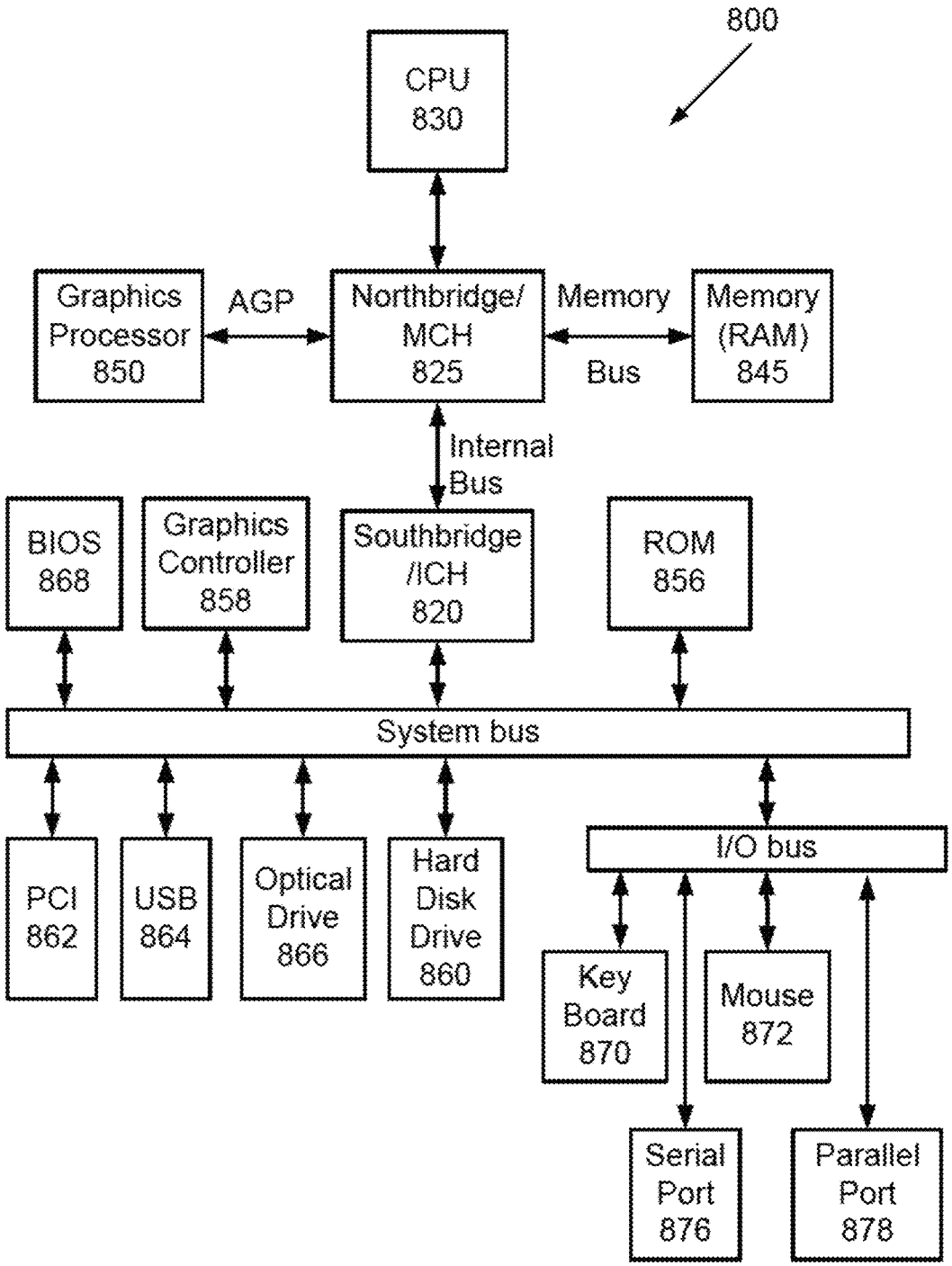
FIG. 8 is an exemplary schematic diagram of a data processing system used within the computing system, according to certain embodiments.

FIG. 8 shows a schematic diagram of a data processing system, according to certain embodiments, for performing space and time determination processes. The data processing system is an example of a computer in which code or instructions implementing the processes of the illustrative embodiments may be located.

In FIG. 8, data processing system 800 employs a hub architecture including a north bridge and memory controller hub (NB/MCH) 825 and a south bridge and input/output (I/O) controller hub (SB/ICH) 820. The central processing unit (CPU) 830 is connected to NB/MCH 825. The NB/MCH 825 also connects to the memory 845 via a memory bus, and connects to the graphics processor 850 via an accelerated graphics port (AGP). The NB/MCH 825 also connects to the SB/ICH 820 via an internal bus (e.g., a unified media interface or a direct media interface). The CPU Processing unit 830 may contain one or more processors and even may be implemented using one or more heterogeneous processor systems.

Figure 9:
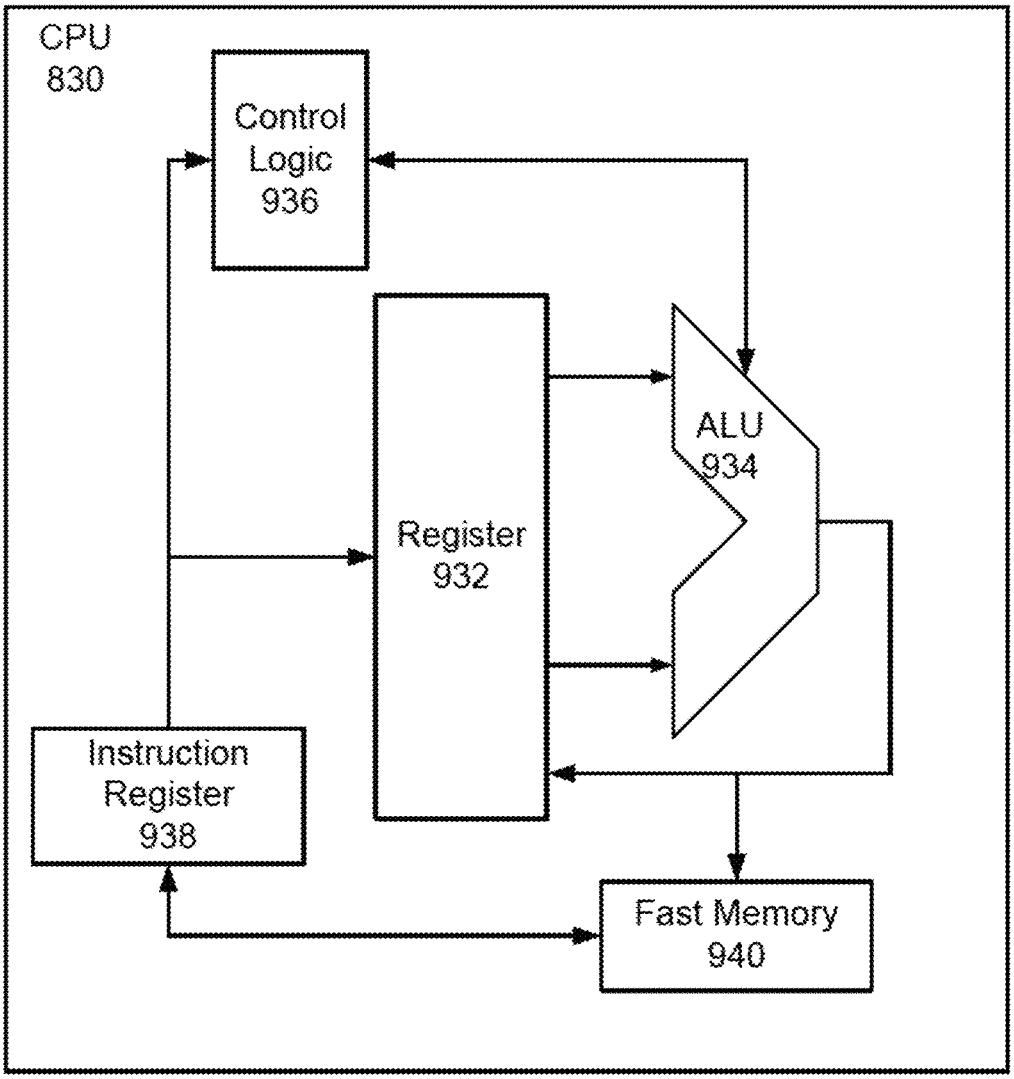
FIG. 9 is an exemplary schematic diagram of a processor used with the computing system, according to certain embodiments.

For example, FIG. 9 shows one implementation of CPU 830. In one implementation, the instruction register 938 retrieves instructions from the fast memory 940. At least part of these instructions are fetched from the instruction register 938 by the control logic 936 and interpreted according to the instruction set architecture of the CPU 830. Part of the instructions can also be directed to the register 932. In one implementation the instructions are decoded according to a hardwired method, and in another implementation the instructions are decoded according a microprogram that translates instructions into sets of CPU configuration signals that are applied sequentially over multiple clock pulses. After fetching and decoding the instructions, the instructions are executed using the arithmetic logic unit (ALU) 934 that loads values from the register 932 and performs logical and mathematical operations on the loaded values according to the instructions. The results from these operations can be feedback into the register and/or stored in the fast memory 940. According to certain implementations, the instruction set architecture of the CPU 830 can use a reduced instruction set architecture, a complex instruction set architecture, a vector processor architecture, a very large instruction word architecture. Furthermore, the CPU 830 can be based on the Von Neuman model or the Harvard model. The CPU 830 can be a digital signal processor, an FPGA, an ASIC, a PLA, a PLD, or a CPLD. Further, the CPU 830 can be an x86 processor by Intel or by AMD; an ARM processor, a Power architecture processor by, e.g., IBM; a SPARC architecture processor by Sun Microsystems or by Oracle; or other known CPU architecture.

Referring again to FIG. 8, the data processing system 800 can include that the SB/ICH 820 is coupled through a system bus to an I/O Bus, a read only memory (ROM) 856, universal serial bus (USB) port 864, a flash binary input/output system (BIOS) 868, and a graphics controller 858. PCI/PCIe devices can also be coupled to SB/ICH 820 through a PCI bus 862.

The processing module may include, for example, Ethernet adapters, add-in cards, and PC cards for notebook computers. The Hard disk drive 860 and CD-ROM 866 can use, for example, an integrated drive electronics (IDE) or serial advanced technology attachment (SATA) interface. In one implementation the I/O bus can include a super I/O (SIO) device.

Further, the hard disk drive (HDD) 860 and optical drive 866 can also be coupled to the SB/ICH 820 through a system bus. In one implementation, a keyboard 870, a mouse 872, a parallel port 878, and a serial port 876 can be connected to the system bust through the I/O bus.

Other peripherals and devices that can be connected to the SB/ICH 820 using a mass storage controller such as SATA or PATA, an Ethernet port, an ISA bus, a LPC bridge, SMBus, a DMA controller, and an Audio Codec.

Moreover, the present disclosure is not limited to the specific circuit elements described herein, nor is the present disclosure limited to the specific sizing and classification of these elements. For example, the skilled artisan will appreciate that the circuitry described herein may be adapted based on changes on battery sizing and chemistry, or based on the requirements of the intended back-up load to be powered.

Figure 10:
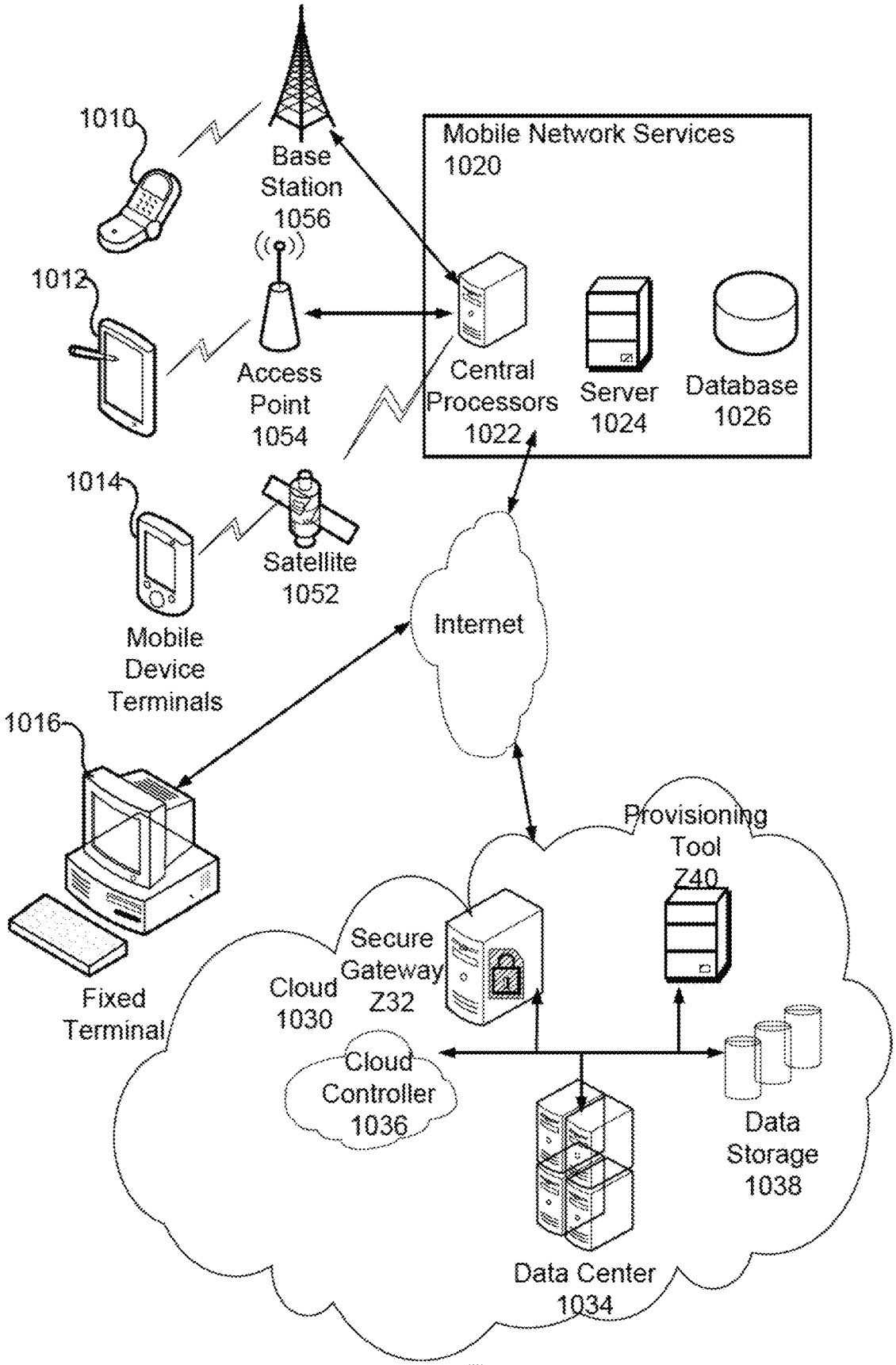
FIG. 10 is an illustration of a non-limiting example of distributed components which may share processing with the controller, according to certain embodiments.

The functions and features described herein may also be executed by various distributed components of a system. For example, one or more processors may execute these system functions, wherein the processors are distributed across multiple components communicating in a network. The distributed components may include one or more client and server machines, which may share processing, as shown on FIG. 10, in addition to various human interface and communication devices (e.g., display monitors, smart phones, tablets, personal digital assistants (PDAs)). The network may be a private network, such as a LAN or WAN, or may be a public network, such as the Internet. Input to the system may be received via direct user input and received remotely either in real-time or as a batch process. Additionally, some implementations may be performed on modules or hardware not identical to those described. Accordingly, other implementations are within the scope that may be claimed.

The above-described hardware description is a non-limiting example of corresponding structure for performing the functionality described herein.

Terminology. Terminology used herein is for the purpose of describing particular embodiments only and is not intended to be limiting of the invention. The headings (such as "Background" and "Summary") and sub-headings used herein are intended only for general organization of topics within the present invention, and are not intended to limit the disclosure of the present invention or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

As used herein, the singular forms "a", "an" and "the" are intended to include the plural forms as well, unless the context clearly indicates otherwise.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

As used herein, the term "and/or" includes any and all combinations of one or more of the associated listed items and may be abbreviated as "/".

Links are disabled by deletion of http: or by insertion of a space or underlined space before www. In some instances, the text available via the link on the "last accessed" date may be incorporated by reference.

As used herein in the specification and claims, including as used in the examples and unless otherwise expressly specified, all numbers may be read as if prefaced by the word "substantially", "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), +/−15% of the stated value (or range of values), +/−20% of the stated value (or range of values), etc. Any numerical range recited herein is intended to include all sub-ranges subsumed therein.

Disclosure of values and ranges of values for specific parameters (such as times, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10 it also describes subranges for Parameter X including 1-9, 1-8, 1-7, 2-9, 2-8, 2-7, 3-9, 3-8, 3-7, 2-8, 3-7, 4-6, or 7-10, 8-10 or 9-10 as mere examples. A range encompasses its endpoints as well as values inside of an endpoint, for example, the range 0-5 includes 0, >0, 1, 2, 3, 4, <5 and 5.

As used herein, the words "preferred" and "preferably" refer to embodiments of the technology that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the technology.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

Spatially relative terms, such as "under", "below", "lower", "over", "upper", "in front of" or "behind" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

Obviously, numerous modifications and variations of the present disclosure are possible in light of the above teachings. It is therefore to be understood that within the scope of the appended claims, the invention may be practiced otherwise than as specifically described herein.

The invention claimed is:

1. A method for determining space allocation and signal timing for traffic flow in a plurality of traffic lanes of an isolated signalized intersection of two roads, each road comprising parallel opposing traffic lanes, comprising:

wherein at least one remote server comprises a plurality of traffic-related data of the traffic flow of the isolated signalized intersection, wherein the traffic flow comprises a plurality of phases and wherein each of the phases of the plurality of phases is a directional right of way movement and wherein the traffic-related data includes a volume of vehicles at the isolated signalized intersection;

receiving the plurality of traffic-related data through a processing module, wherein the processing module is communicably coupled with the at least one remote server;

calculating, through the processing module, a set of traffic flow rates for each phase of the plurality of phases, wherein each of the set of traffic flow rates corresponds to a traffic lane of the isolated signalized intersection;

determining, through the processing module, a critical flow rate for each of the plurality of phases by identifying a maximum traffic flow rate of the set of traffic flow rates, wherein the maximum traffic flow rate of each of the plurality of phases is the critical flow rate corresponding to that phase;

determining a first critical flow summation by summing the critical flow rate of each of the plurality of phases associated with an approach-based phasing scheme, wherein the approach based phasing scheme is configured to at least control traffic movement headed towards at least a left direction, a right direction, and a straight direction;

determining a second critical flow summation by summing the critical flow rate of each of the plurality of phases associated with a movement-based phasing scheme, wherein the movement-based phasing scheme is configured to at least control traffic movement of opposite directions;

comparing the first critical flow summation with the second critical flow summation to find a minimum critical flow summation; and selecting the approach-based phasing scheme as a phasing scheme based on the comparison indicating that the first critical flow summation is the minimum critical flow summation.

2. The method for of claim 1, further comprising:

minimizing an average intersection delay for the plurality of traffic-related data using the processing module; and determining a cycle length, through the processing module, wherein the cycle length is based at least upon the selected phasing scheme and the minimized average intersection delay.

3. The method of claim 2, wherein the minimized average intersection delay is within a range of 10 seconds-300 seconds.

4. The method of claim 2, wherein the cycle length is determined for any intersection with any number of legs.

5. The method of claim 2, wherein the cycle length is determined for a four-legged intersection.

6. The method of claim 2, wherein the cycle length is determined for a three-legged intersection.

7. The method of claim 1, further comprising:

selecting the movement-based phasing scheme as another phasing scheme based on the comparison indicating that the second critical flow summation is the minimum critical flow summation.

8. The method of claim 7, further comprising:

wherein a through-traffic volume is considered in the approach-based phasing scheme and the movement-based phasing scheme; and scaling a turning-traffic volume by an equivalent factor, wherein the equivalent factor is a ratio between a saturation flow rate of through traffic and a saturation flow rate of turning traffic.

9. The method of claim 7, further comprising:

when the movement-based phasing scheme is selected the movement-based phasing scheme comprises a plurality of phases;

wherein a corresponding green light time for each phase is stored on the at least one remote server; and allocating, through the at least one remote server, the corresponding green light time according to the critical flow rate of each phase.

10. The method of claim 1, wherein an east-west approach at the isolated signalized intersection is considered independent of a north-south approach at the isolated signalized intersection during the approach-based phasing scheme.

11. The method of claim 1, further comprising:

wherein the approach-based phasing scheme comprises a plurality of phases;

wherein a corresponding green light time for each phase is stored on the at least one remote server; and allocating, through the at least one remote server, the corresponding green light time according to the critical flow rate.

12. The method of in claim 1, wherein a set of results obtained for average intersection delay by implementing the method is superior to a set of results obtained for average intersection delay by implementing existing commercial programs.

13. The method of claim 1, wherein the method is an added module to existing commercial programs to improve an outcome of the existing commercial programs.

* * * * *